United States Patent [19]

Schumacher

[11] 4,056,300

[45] Nov. 1, 1977

[54] TERMINAL CONNECTOR WITH STRESS RELIEF

[75] Inventor: Donald Alfred Schumacher, Lockport, N.Y.

[73] Assignee: GTE Sylvania Incorporated, Stamford, Conn.

[21] Appl. No.: 677,431

[22] Filed: Apr. 15, 1976

Related U.S. Application Data

[63] Continuation of Ser. No. 333,886, Feb. 20, 1973, abandoned.

[51] Int. Cl.[2] ..... H01R 13/58

[52] U.S. Cl. ..... 339/103 R; 339/17 L; 339/184 M; 339/221 M

[58] Field of Search ..... 339/103, 61 M, 17 L, 339/221 M, 42, 93 C, 17 CF, 174, 184 M, 125 R

[56] References Cited

U.S. PATENT DOCUMENTS

| | | | |
|---|---|---|---|
| 3,337,833 | 8/1967 | Creedon | 339/221 M X |
| 3,529,279 | 9/1970 | Logue et al. | 339/125 R |
| 3,651,444 | 3/1972 | Desso et al. | 339/17 L X |
| 3,673,543 | 6/1972 | Garner | 339/61 M |
| 3,719,917 | 3/1973 | Fischer et al. | 339/125 R |

*Primary Examiner*—Roy Lake
*Assistant Examiner*—DeWalden W. Jones
*Attorney, Agent, or Firm*—Norman J. O'Malley; Theodore D. Lindgren; Robert T. Orner

[57] ABSTRACT

A terminal connector having a strip carrying pressure fitted terminals is shown. Openings or notches between the lands carrying the pressure fitted terminals relieve stresses in the strip to reduce longitudinal extension and bowing of the strip.

4 Claims, 6 Drawing Figures

TERMINAL CONNECTOR WITH STRESS RELIEF

This is a continuation of application Ser. No. 333,886, filed Feb. 20, 1973, now abandoned.

BACKGROUND OF THE INVENTION

This invention relates to connectors for pluggable engagement between terminals carried by the connector and terminals carried by a panel. More particularly the invention relates to connectors carrying pressure fitted terminals thereon.

Connectors using terminal strips with pressure fitted terminals are well known in the art. For example, AMP Incorporated catalog No. 902-9 issued Dec. 1970 illustrates and describes a variety of such connectors. Such connectors, however, suffer from a number of disadvantages. For example, prior art terminal strips are limited in length and the number of terminals permitted in a signal strip because long strips tend to expand longitudinally or bow when the pressure fitted terminals are inserted thereby destroying the mating fit with the mating part. Thus, where a long connector with numerous terminals is required, the limitations of the prior art connectors necessitate resort to such techniques as a series of short connectors mounted separately or other complex, costly, and unreliable alternatives.

OBJECTS AND SUMMARY OF THE INVENTION

Accordingly, it is a primary object of this invention to obviate the above-noted disadvantages of the prior art.

It is a further object to provide an economical, reliable, and simple connector for large numbers of terminals.

It is a still further object to provide a connector with a terminal strip carrying pressure fitted terminals without distortion of the terminal strip.

In one embodiment of this invention the above and other objects and advantages are achieved in a connector for pluggable engagement between terminals carried by the connector and terminals carried by a panel. The connector includes a longitudinal member or strip of insulative material having a plurality of lands arrayed longitudinally with each of the lands having an opening for receiving a terminal pressure fitted therein. Slots extending through the member or strip between adjacent pairs of the lands relieve stresses in the strip due to the pressure fitting of the terminals.

DETAILED DESCRIPTION OF THE PREFERRED EMBODIMENTS

Figure 1:
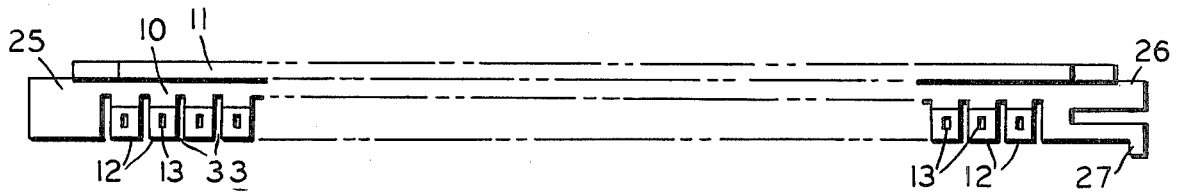
FIG. 1 is a top view of one embodiment of the invention.
Figure 2:
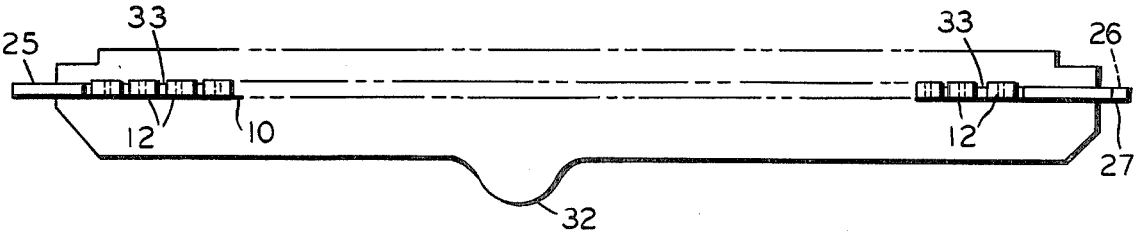
FIG. 2 is a front view of the embodiment shown in FIG. 1.
Figure 3:
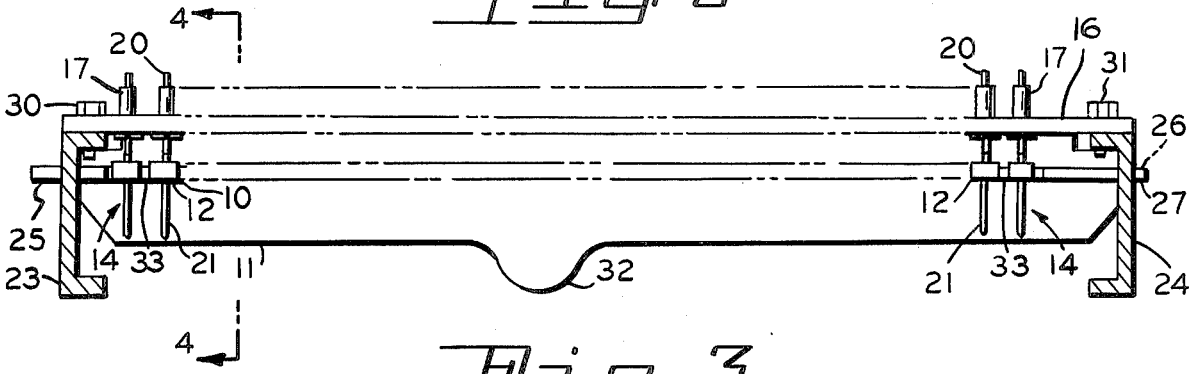
FIG. 3 illustrates the embodiment of FIGS. 1 and 2 assembled in a television chassis.
Figure 4:
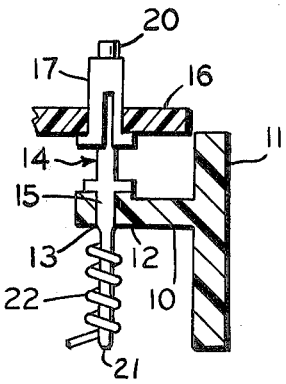
FIG. 4 is a sectional view illustrating some of the structure of FIGS. 1–3 in greater detail.

For a better understanding of the present invention, together with other and further objects, advantages and capabilities thereof, reference is made to the following disclosure and appended claims in connection with the above-described drawings.

One embodiment of a connector in accordance with the invention is illustrated in FIGS. 1, 2, 3, and 4. The connector includes a longitudinal or flat member or strip 10 constructed of insulative material such as a suitable plastic. Suitable insulative materials include plastics commonly used for injection molding and any material which is elastic in the sense that the material may undergo a limited amount of compression or expansion without permanent injury such as cracking or breaking. One edge of strip 10 is attached to a wall member 11 preferably constructed of the same material as strip 10. Strip 10 and wall member 11 can be molded in one integral operation. Strip 10 has a plurality of lands 12 arrayed longitudinally along strip 10, and each of lands 12 has an opening 13 extending therethrough for receiving a terminal 14 pressure fitted therein. Lands 12 can be, but are not necessarily, raised or thicker than strip 10. Terminals 14 of the type illustrated have a shoulder and a broadened portion 15 which engages the sides of opening 13 to provide a tight pressure fit so that a panel 16 carrying mating terminals 17 can be plugged or detachably mounted on an upstanding portion 20 of terminals 14. Panel 16 can be a printed circuit panel which carries printed circuitry and electrical components such as, for example, a portion of the circuitry found in typical television receivers. Printed conductors or other suitable means on panel 16 electrically contact terminals 17 to provide interconnection paths via terminals 17 and 14 to portions 21 of terminals 14 depending below strip 10. Electrical connections to portions 21 of terminals 14 can be made by a wire wrapped conductor 22 or by other suitable means such as soldering. Terminals suitable for terminals 14 and 17 are commercially available and are illustrated in the above-described AMP Incorporated catalog.

The connectors are mounted in a suitable chassis of which edge pieces 23 and 24 are shown in section. The mounting means includes extensions or tabs 25 and 26 on opposite ends of strip 10 which are inserted through corresponding slots in chassis edge pieces 23 and 24. Tab 26 has a flexible latch 27 which is depressed when tab 26 is inserted into the corresponding slot in edge piece 24 to latch the connector to the chassis. Panel 16 can also be attached to edge pieces 23 and 24 by suitable screws 30 and 31 to prevent panel 16 from becoming dislodged upon movement of the chassis. Terminals 14 and 17 are preferably frictionally engaged. When panel 16 is pressed down to mate terminals 14 and 17, the connector may deflect downward. A protuberance 32 is provided depending from one edge of wall member 11 and engages the surface on which the chassis is resting to prevent excessive downward deflection of the connector.

Strip 10 further includes a plurality of openings or slots 33 between adjacent pairs of lands 12. When terminals 14 are press fitted into openings 13, the material of lands 12 is displaced. If slots 33 were not present, the longitudinal displacement along the length of strip 10 would cause a longitudinal extension of strip 10. With wall member 11 attached to one edge of strip 10, the connector would bow thereby destroying the mating fit between terminals 14 and terminals 17 of panel 16. The mating fit would also be deleteriously affected if wall member 11 were not present because of the longitudinal extension and bowing of strip 10. Slots 33 however relieve the internal stresses or pressures in strip 10 due to the pressure fitting of terminals 14 in openings 13 to eliminate or substantially reduce extension and bowing of the connector. While preferably there is a slot 13 between each adjacent pair of lands 12, satisfactory performance can be obtained for some applications where fewer slots are provided. For example, in some applications it may be necessary to provide slots only between every other adjacent pair of lands.

Figure 5:
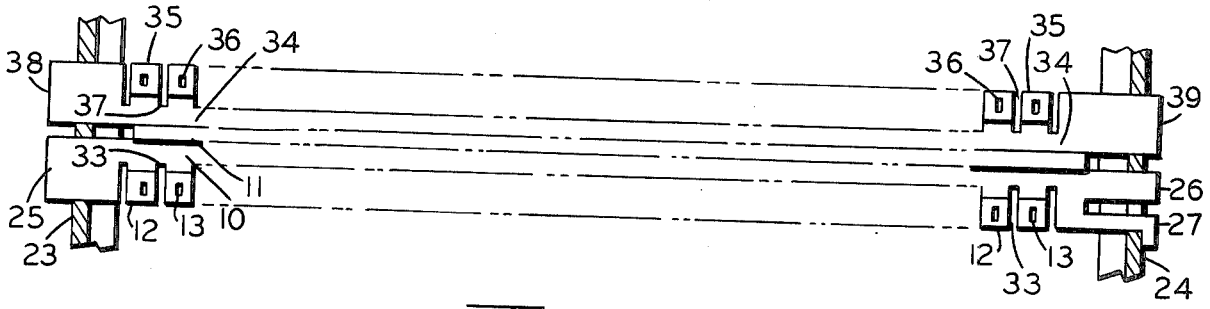
FIG. 5 is a top view of a second embodiment of the invention.

FIG. 5 illustrates a second embodiment of the invention wherein a second longitudinal or flat insulative strip or member 34 is attached on one edge thereof to the side of wall member 11 opposite strip 10. Strip 34 has lands 35 with openings 36 and openings or slots 37 similar to lands 12, openings 13, and slots 33 of strip 10. Openings 36 receive terminals similar to terminals 14 which mate with cooperating terminals on a second panel. Thus, the connector of FIG. 5 can pluggably engage the terminals of two separate panels on opposite sides of wall member 11. Strip 34 includes extensions or tabs 38 and 39 on opposite ends thereof for insertion through corresponding slots in chassis edge pieces 23 and 24 which are shown in section.

Figure 6:
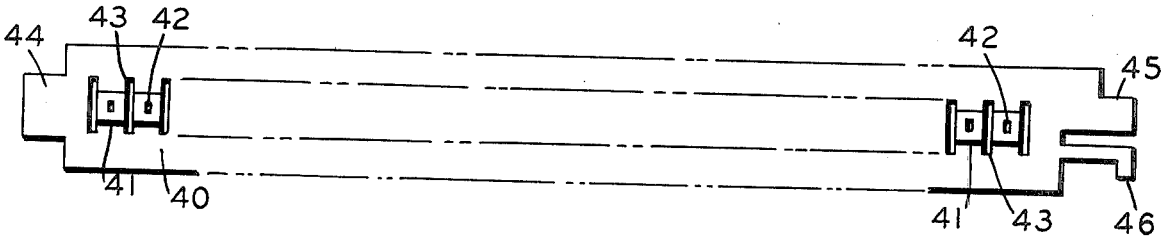
FIG. 6 is a top view of a third embodiment of the invention.

FIG. 6 illustrates a third embodiment of the invention wherein a longitudinal or flat member or strip of insulative material 40 has lands 41 with openings 42. Lands 41 are separated by slots or openings 43 similar to lands 12, openings 13, and slots 33 except that lands 41 are not along the edge of strip 40 and slots 43 do not extend to the edge of strip 40. Strip 40 has extensions or tabs 44 and 45 on opposite ends thereof for engagement with corresponding slots of a chassis. Tab 45 has a flexible latch 46 similar to latch 27. In the embodiment of FIG. 6 a wall member could be added if desired. Slots 43 effectively relieve stresses in strip 40 due to insertion of press fitted terminals in openings 42 thereby eliminating or reducing longitudinal extension of strip 40.

Accordingly, there has been shown and described various embodiments of connectors in accordance with the subject invention. The invention permits the use of pressure fitted terminals in long strip connectors without substantial distortion due to longitudinal extension or bowing of the connector.

While there have been shown and described what are at present considered the preferred embodiments of the invention, it will be obvious to those skilled in the art that various changes and modifications may be made therein without departing from the scope of the invention as defined by the appended claims.

What is claimed is:

1. A connector for pluggable engagement between terminals carried by said connector and terminals carried by a panel comprising:

a strip member of elastic insulating material having a plurality of lands arrayed longitudinally on one edge on said member, said lands formed by a plurality of slots extending through said strip member transversely to the longitudinal dimension thereof, each of said lands having a single opening located substantially within said lands and extending through said lands, terminals pressure fitted through more than one of said openings with sufficient force to cause said elastic insulating material to be displaced, said terminals extending on both sides of said strip member for mating electrical connections thereto.

2. A connector as defined in claim 1 wherein said strip member has a wall member attached substantially perpendicularly thereto on the edge thereof opposite to said longitudinally arrayed lands.

3. A connector as defined in claim 1 wherein said strip member has a plurality of said lands arrayed longitudinally on both edges of said member.

4. A connector as defined in claim 3 wherein said strip member has a wall member attached substantially perpendicularly thereto and located between said longitudinally arrayed lands.

* * * * *